United States Patent [19]

Corniea et al.

[11] Patent Number: 4,903,740

[45] Date of Patent: Feb. 27, 1990

[54] METHOD AND APPARATUS FOR MINIMIZING FOAM IN FILLING CARTONS

[75] Inventors: Donald G. Corniea, Inver Grove; Dale J. Kelash, Apple Valley, both of Minn.

[73] Assignee: Tetra Pak Finance & Trading S.A., Pully, Switzerland

[21] Appl. No.: 205,271

[22] Filed: Jun. 10, 1988

[51] Int. Cl.[4] ..... B65B 3/06

[52] U.S. Cl. ..... 141/1; 141/284; 141/302; 222/449; 222/450; 222/504

[58] Field of Search ..... 141/1, 2, 4, 5, 114, 141/284, 286, 301, 302, 309; 417/472, 473; 92/34, 37, 38, 39; 222/56, 442, 424, 5, 449, 450, 504, 453

[56] References Cited

U.S. PATENT DOCUMENTS

| | | | |
|---|---|---|---|
| 2,492,280 | 12/1949 | Groves | 137/493.3 |
| 2,820,579 | 1/1958 | Roth | 222/453 X |
| 3,514,222 | 5/1970 | Korotkov et al. | 417/214 |
| 3,802,322 | 4/1974 | Johnson et al. | 92/34 |
| 4,437,498 | 3/1984 | Pankratz et al. | 141/89 |
| 4,515,530 | 5/1985 | Christoleit | 417/214 |
| 4,648,421 | 3/1987 | Chant et al. | 137/312 |

*Primary Examiner*—Henry J. Recla
*Assistant Examiner*—J. Casimer Jacyna
*Attorney, Agent, or Firm*—Burns, Doane, Swecker & Mathis

[57] ABSTRACT

Apparatus for dispensing a predetermined quantity of product liquid into a series of cartons in sequence is described. The apparatus includes a discharge valve arrangement that directs the liquid obliquely against the wall of the carton to reduce the tendency to produce foam. Also, the apparatus includes a bellows and valve system for controlling the flow of liquid to the discharge valve. A method of operating the system that is described minimizes the liquid pressure differential at the discharge valve when the valve opens.

21 Claims, 4 Drawing Sheets

PRODUCT SOURCE 6
4
21
20
20
71
10
52
60
48
64
16
12
66
62
68
2
54
46
50
18
74
72
58
70
14
59
73
8
56
20
20
44

10
20
71
26
16
22
24
52
48
60
64
68
66
12
75
36
54
46
4
4
18
38
50
74
72
34
58
70
14
73
40
8
30
29
20
32
32
42
31

Fig. 3
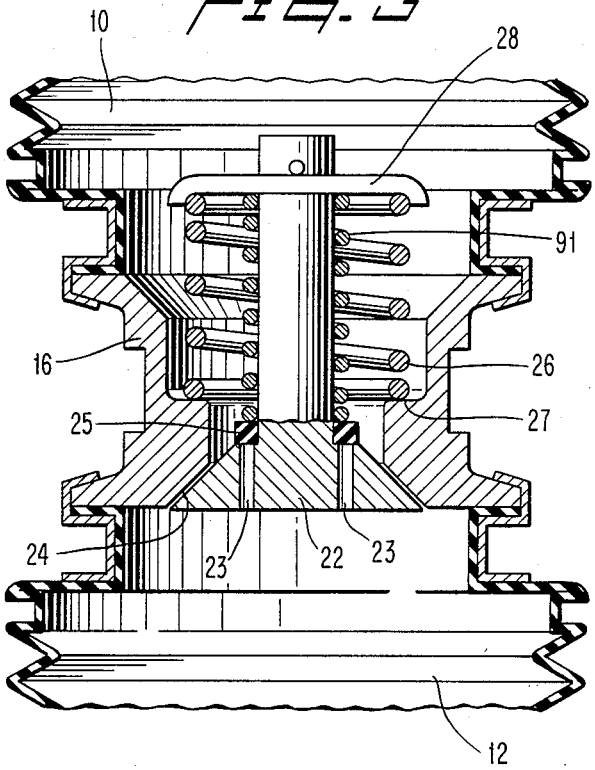
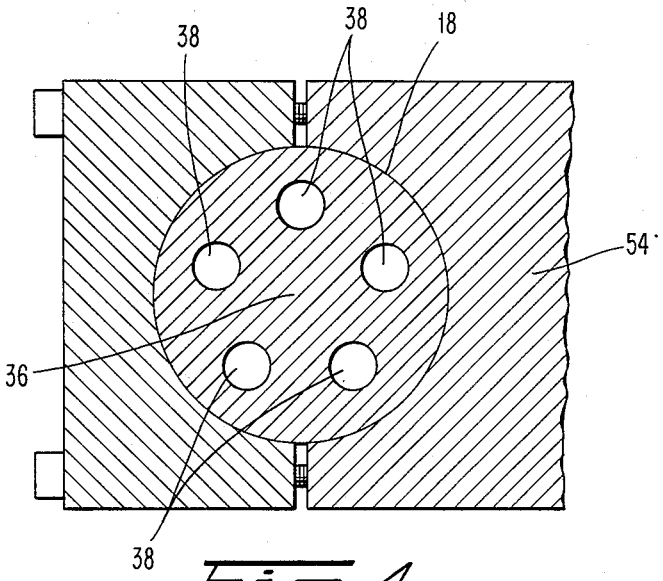
Fig. 4

METHOD AND APPARATUS FOR MINIMIZING FOAM IN FILLING CARTONS

BACKGROUND OF THE INVENTION

The present invention relates to automatic filling machines wherein empty cartons are conveyed along a path while being filled with liquid and sealed, and more particularly to liquid dispensing units for such machines.

High speed automatic filling machines such as is disclosed in U.S. Pat. No. 4,448,008, have been used for filling cartons with liquids, such as milk and juices. These filling machines are required to dispense a predetermined quantity of liquid in each carton as it advances through the filling section of the machine.

One type of dispensing unit that has been used is a double bellows type apparatus such as that disclosed in U.S. Pat. No. 4,402,461. This patent discloses a dispensing unit having a pair of bellows interconnected by a sleeve containing a spring-biased check valve that controls the flow of fluid from the upper bellows to the lower bellows. A fixed discharge nozzle is mounted at the lower end of the lower bellows, and a movable discharge valve element is biased toward a closed position by a spring. The sleeve is mounted for reciprocating movement in an axial direction toward and away from the fixed nozzle. The end of each bellows that is connected with the sleeve moves with it. The opposite ends of the respective bellows are held stationary, so that the axial movement of the sleeve toward the nozzle compresses the lower bellows and expands the upper bellows.

An actuator raises the sleeve vertically to contract the upper bellows while simultaneously expanding the lower bellows. This action opens the check valve in the sleeve and allows liquid to flow from the upper bellows into the lower bellows. The check valve closes when the movement of the sleeve stops. The actuator then lowers the sleeve to expand the upper bellows while simultaneously contracting the lower bellows. The increase in pressure in the lower bellows overcomes the spring force on the discharge valve element, thereby causing the valve to open, and the liquid present in the lower bellows flows into a carton. The sequence is then repeated transferring liquid sequentially from a supply source into the upper bellows, then into the lower bellows, and finally into the individual cartons.

Since these dispensing units are primarily used for liquid food products, such as milk, or other dairy products, the filling process must be carried out under aseptic, or hygienic conditions. There must be no opportunity for contamination to occur during the filling operation. The units must be designed to prevent bacteria from entering the carton or the filling nozzle during the filling process, since this would cause the bacteria to enter the liquid food product and to be packaged in the carton with the product.

In prior filling systems, it has been found that there is a tendency when filling cartons with milk, for example, that the liquid flow pattern generates foam on top of the liquid contents in the carton. The presence of foam interferes with the closing and sealing of the carton. The presence of foam also is a limiting factor in attempting to increase the rate of filling of the cartons. The presence of foam may lead to unhygienic filling conditions. Attempts have been made to reduce the amount of foam that is present during the filling operation. For example, U.S. Pat. No. 4,375,145 discloses in FIG. 10 apparatus for filling a carton in a manner that the generation of foam is minimized. U.S. Pat. No. 4,448,008 discloses the use of tubes to draw off any foam that may be present (Col. 8, lines 11–16).

SUMMARY AND OBJECTS OF THE INVENTION

In view of the deficiencies of prior liquid dispensing units, particularly for liquid food products, it is an object of this invention to provide a liquid dispensing unit which is accurate and efficient in dispensing liquids.

Another object of this invention is to provide a liquid dispensing unit in which the generation of foam in the carton as it is being filled is minimized.

It is a further object of this invention to provide a liquid dispensing unit that is capable of filling cartons rapidly while maintaining hygienic conditions.

These objects are accomplished in accordance with the present invention by providing three axially-aligned bellows assemblies with a pair of movable sleeves interposed between the bellows. A discharge nozzle, which is mounted on a stationary support is connected with the lower end of the lower bellows. A movable discharge valve element is received in the interior bore of the nozzle to control the flow of liquid out of the nozzle. A valve stem extends from the discharge valve element to the lower movable sleeve, so that downward displacement of the lower movable sleeve displaces the discharge valve element to an open position. A spring in the nozzle bore urges the valve element toward a closed position. To control the flow of liquid from the upper bellows to the middle bellows, a spring-biased check valve is provided in the upper movable sleeve. The discharge valve element has a configuration which guides the flow of liquid outwardly to impinge on the interior surface of the carton at an angle which minimizes the formation of foam.

Reciprocating motion is imparted to the upper and lower sleeves by a cam arrangement and by pneumatic rams. The motion of the lower sleeve is controlled in such a manner that the hydrostatic pressure in the lower bellows is increased only slightly above atmospheric pressure at the time the valve element is displaced off of the valve seat, so that very little energy is available to accelerate the liquid as it passes through the discharge valve. The motion of the upper sleeve is coordinated with that of the lower sleeve, so that the interior of the lower bellows is replenished while the discharge valve is closed.

BRIEF DESCRIPTION OF THE DRAWINGS

A preferred embodiment of the invention is illustrated in the accompanying drawings, in which:

FIG. 3 is an enlarged cross-sectional view of the upper valve sleeve as in FIG. 2;

FIG. 4 is a cross-sectional view of the lower sleeve along the line 4—4 in FIG. 2;

DETAILED DESCRIPTION

Figure 1:
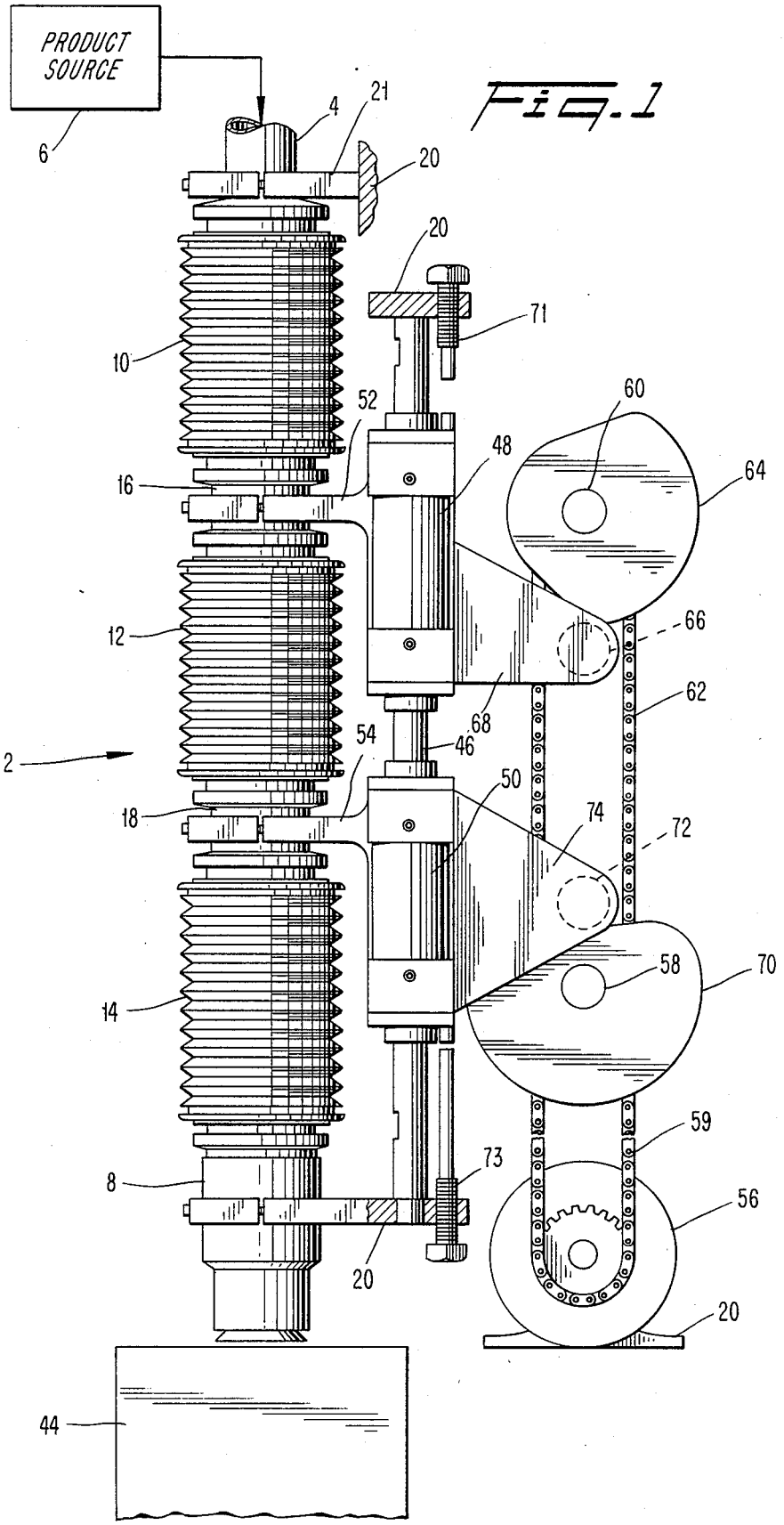
FIG. 1 is an elevational view, partially schematic, showing the liquid dispensing unit in accordance with this invention.

A preferred embodiment of this invention is shown in FIG. 1. The dispensing unit 2 is mounted on a substantially vertical axis, and is provided with an inlet conduit 4 which is supplied with liquid from a product source 6. The dispensing unit includes a discharge valve assembly 8 and three bellows 10, 12 and 14. Between the upper and middle bellows, 10 and 12, an upper sleeve 16 is mounted. Between the middle bellows 12 and the lower bellows 14, a lower sleeve 18 is mounted. The dispensing unit 2 is mounted on the machine frame which is shown schematically at 20. A bracket 21 on the frame 20 holds the inlet pipe for the upper bellows 10 stationary and in axial alignment with the discharge valve assembly 8.

Figure 2:
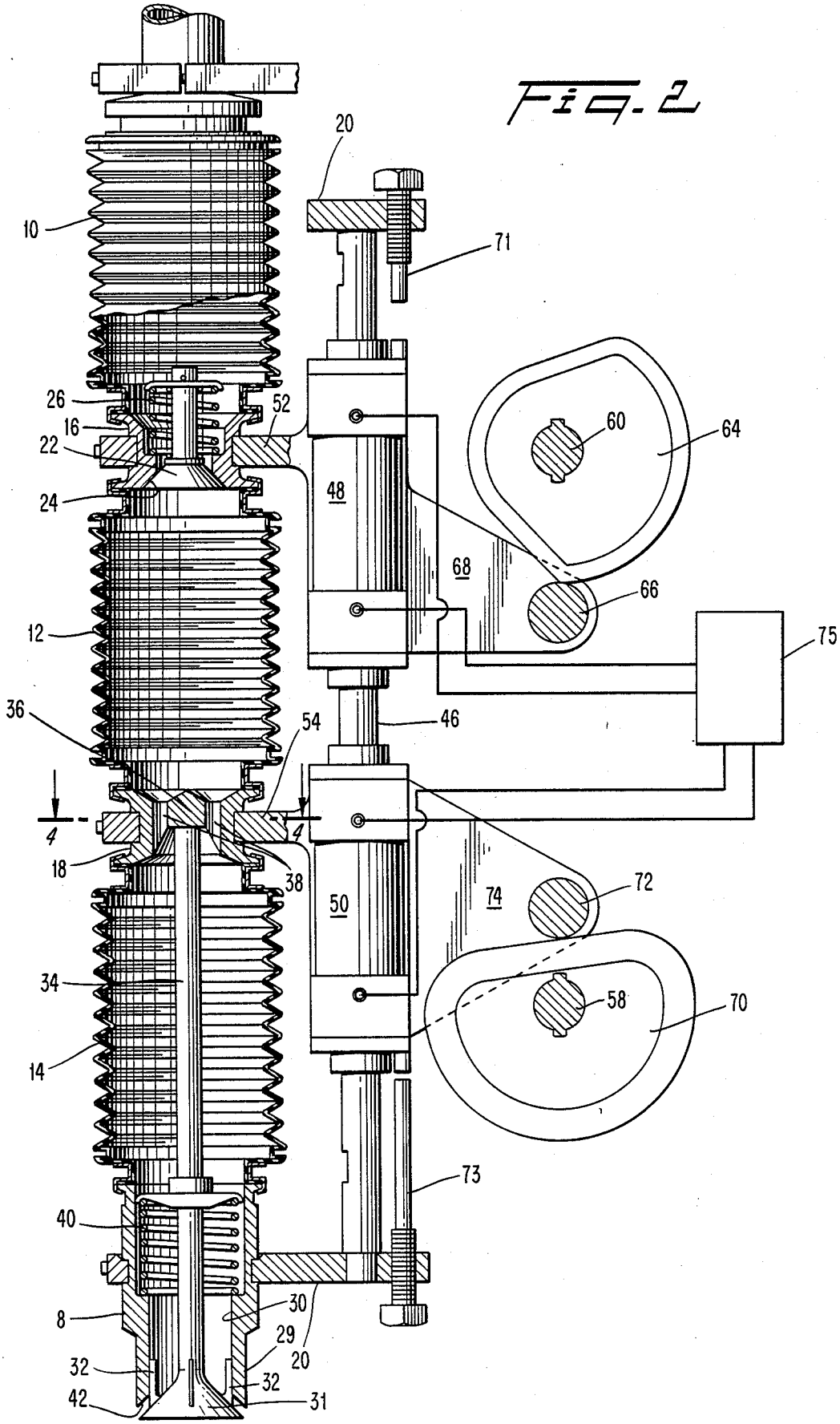
FIG. 2 is a cross-sectional view, partially schematic, of the dispensing unit as in FIG. 1.

As shown in FIG. 2, the upper valve sleeve 16 includes a movable valve element 22 which is mounted for reciprocating movement toward and away from a valve seat 24 which is formed in the sleeve 16. The valve element 22, as shown in FIG. 3, is biased upwardly into engagement with the seat 24 by means of a spring 26. The spring 26 is compressed between a shoulder 27 in the sleeve 16 and a retainer 28 that is secured on the stem of the valve element 22. The valve element includes a purge valve arrangement for purging air from the middle and lower bellows during the initial filling of the system with liquid. The purge valve arrangement includes a plurality of vent passages 23. These passages are covered by a seal ring 25. The seal ring 25 is biased toward the valve element 22 by a purge spring 91 that is mounted between the retainer 28 and the valve element 22. The purge valve arrangement is described in the copending application, Ser. No. 07/036,992, which is incorporated herein as if fully set forth.

Figure 5:
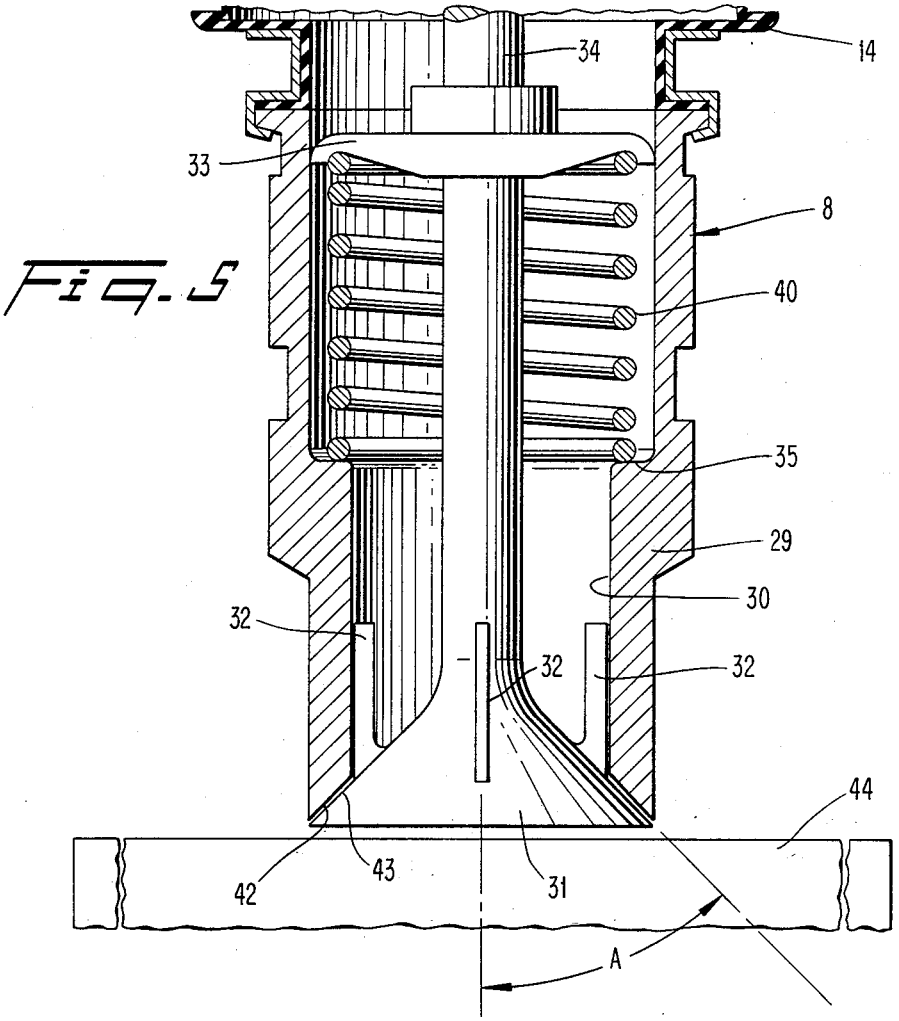
FIG. 5 is a detail view, partially in cross-section, showing the valve element of the discharge valve.

The discharge valve assembly 8 is mounted in a fixed position on the frame 20 and includes a nozzle 29 having an internal bore 30 in which a movable valve element 31 is received (FIG. 5). The valve element 31 has a plurality of guides 32 which are received in the nozzle 29 to support the valve element 31 in alignment with the central axis of the nozzle 29. The valve element 31 has a valve stem 34 which extends upwardly through the nozzle 29 and through the lower bellows 14.

The lower sleeve 18 has a central hub 36 and a plurality of axial passages 38 which allow liquid to flow between the middle bellows 12 and the lower bellows 14. A spring 40 in the nozzle 29 is compressed between a retainer 33 on the valve stem 34 and a shoulder 35 in the interior of the nozzle 29. The spring 40 urges the valve element 31 upwardly against the valve seat 42 at the lower end of the nozzle 29. An important feature of this assembly is that the valve stem 34 engages the hub 36, so that the downward movement of the hub forces the valve element 31 to open. During upward movement of the hub 36, the spring maintains the valve stem 34 in engagement with the hub 36. To assure that the valve element 31 engages the valve seat 42, the sleeve 18 moves upwardly a slightly greater distance than is necessary to allow the element 31 to engage the valve seat 42. Thus, when the element 31 is fully closed, there is a slight gap between the hub and the end of the valve stem 34. As shown in FIG. 5, the valve seat 42 is preferably conical and the engagement surface 43 of the element 31 has a corresponding shape.

The motions of the upper sleeve 16 and lower sleeve 18 control the flow of liquid out of the discharge valve 8 and into a carton 44 (FIG. 1) which is positioned under the valve assembly 8. As shown in FIGS. 1 and 2, a vertical post 46 is mounted on the frame 20 in parallel relation to the bellows 10, 12, 14, and the sleeves 16, 18. The post 46 serves as a guide for reciprocating air cylinders 48 and 50. The upper air cylinder 48 is secured to the sleeve 16 by a rigid arm 52. Similarly, the lower air cylinder 50 is secured to the lower sleeve 18 by a rigid arm 54.

A cam drive motor 56 (FIG. 1) is mounted on the machine frame 20 adjacent to the air cylinders 48 and 50, respectively. The motor 56 rotates an intermediate shaft 58 by means of a drive chain 59. An upper shaft 60 is also driven by the motor 56 by means of a drive chain 62 between the shaft 58 and the shaft 60. The upper shaft 60 has a cam 64 which cooperates with a cam follower 66 that is secured on a bracket 68 which extends outwardly from the air cylinder 48. The lower shaft 58 also has a cam 70 which is in position to engage a cam follower 72 that is mounted on a bracket 74 extending outwardly from the lower air cylinder 50. The operation of the air cylinders 48 and 50 is controlled by a conventional pneumatic control system 75 which supplies air to the respective ends of the air cylinders 48 and 50 to displace the cylinders 48 and 50 selectively upward or downward along the post 46. The pneumatic control system maintains air pressure in the cylinders 48 and 50 to urge the followers 66 and 72 into engagement with the cams 64 and 70. Stops 71 and 73 are mounted on the post 46 to limit the movement of the respective cylinders 48 and 50.

The operation of the dispensing unit is controlled by the cams 64 and 70 and the air cylinders 48 and 50 to adjust the flow of liquid through the bellows, so that when the valve element 31 moves away from the valve seat 42 to begin filling a carton, the liquid pressure differential between the interior of the nozzle 29 and the atmosphere outside the nozzle is relatively low. By maintaining a low pressure differential at the nozzle 29, the liquid does not accelerate rapidly (squirt) into the carton which, if it occurred, would produce foaming. As shown in FIG. 5, it is also important that the engagement surface 43 of the valve element and the valve seat 42 direct the liquid obliquely against the side wall of the carton. The slope of the surface is designated by the angle A and it has been found that this angle is preferably between about 20 degrees and 60 degrees for minimizing foam formation in milk, depending on the size of the carton. Since the valve seat 42 and the engagement surface 43 are substantially parallel, as the valve element 31 moves away from the valve seat 42, the cross-sectional area of the flow passage for the liquid remains substantially constant as the liquid flows outwardly between the surface 43 and the seat 42. In the embodiment illustrated in the drawings, the valve seat 42 has an angle A of 45 degrees and the engagement surface 43 of the valve element has an angle A of 46 degrees. This slight difference in the angle causes the surfaces to converge at the very outer edge when the surfaces are in engagement with each other. As a result, a good seal is formed and there is no leakage.

As explained with respect to prior fill systems in which the discharge valve was opened in response to an increase in pressure in the lower bellows, the pressure differential upon opening of the discharge valve causes the liquid to be accelerated toward the wall of the carton, thereby generating foam when the liquid stream hits the wall. The fill system of this invention avoids this problem by keeping the pressure in the lower bellows at about atmospheric pressure when the valve 31 opens. This requires coordinated motion of the bellows and the discharge valve.

It was found that the discharge valve must be open before the fill stroke begins and the fill stroke must be finished before the discharge valve begins closing. The valve must close as slowly as possible but it must be fully closed by the time the recharge stroke begins. The relationship between the opening and closing movement of the valve element 31 and the displacement of sleeves 16 and 18 that expand and contract the bellows is shown graphically in FIG. 6. The fill stroke begins at 76 on the valve displacement graph by the sleeve 18 (FIG. 2) beginning to move downward. This movement displaces the valve element 31 downwardly toward the fully open position. After a brief interval, the sleeve 16 begins to move downwardly, as shown at 78 in FIG. 6. Since the liquid product flows freely through the sleeve 18, the liquid is transferred from the middle bellows 12 into the lower bellows 14 without any substantial increase in the liquid pressure in the middle bellows. Also, since the discharge valve element 31 is fully open a short interval after the upper bellows begins its stroke, there is substantially no increase in the pressure in the lower bellows.

Figure 6:
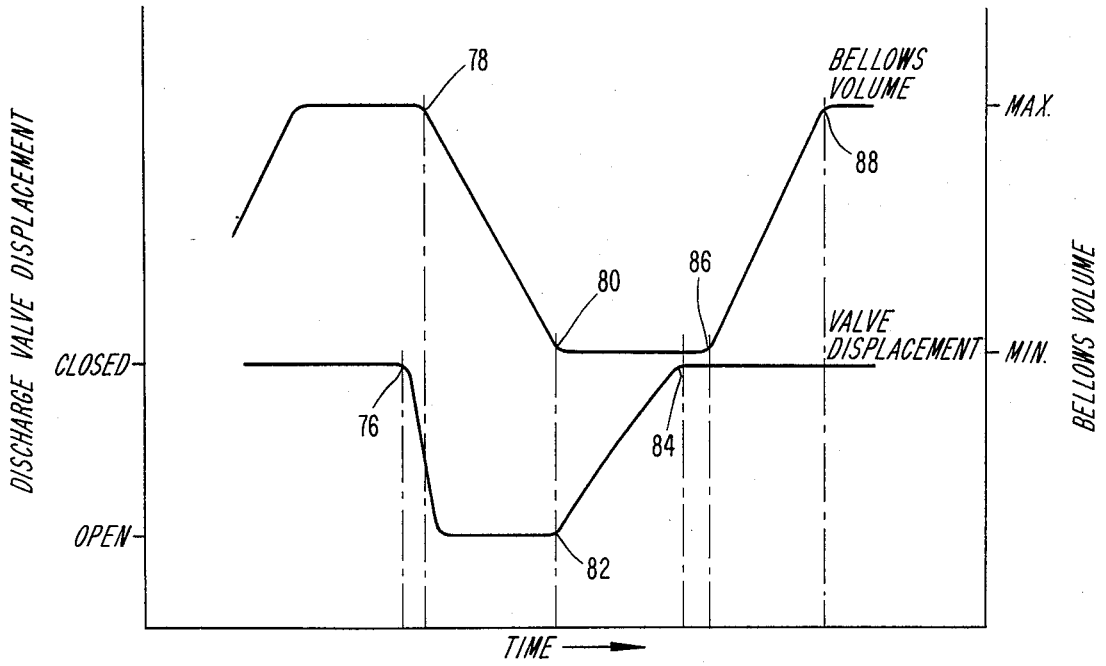
FIG. 6 is a graph showing the motion of the upper and lower valve sleeves of the dispensing unit.

As soon as the fill stroke of the sleeve 16 ends, as shown at 80 in FIG. 6, the discharge valve element 31 begins to close, as indicated at 82. The closing stroke of the valve element 31 occurs at a rapid rate during the first part of the stroke and the valve element is decelerated at a lower rate until the valve element is seated, as indicated at 84. A brief interval after the valve is seated, the sleeve 16 begins its upward stroke at 86, to recharge the product liquid in the bellows 12 and 14. When the sleeve 16 reaches the top of its stroke, at 88, the system is ready to begin the next fill cycle.

As an example, the cycle begins at 78 with a gap of 0.200 inches or more between the surface 43 and the valve seat 42. The fill stroke then begins. As soon as the fill stroke ends 80, the valve 82 begins to close. When the valve surface 43 is fully seated on the valve seat 42, at 84, the recharge stroke begins 86. During closing the valve, it is preferably accelerated at a very high rate, approximately 450 inches per second per second and then decelerated at a low rate, approximately 13 inches per second per second, until the valve is seated.

Another feature of the invention for reducing the foam level in the carton is the number and shape of the guides 32 on the valve element 31. Although four guides 32 are illustrated in the drawings, there may be as few as one guide. One of the purposes of the guide is to allow air to vent from the carton through the stream of liquid. Each guide breaks the stream and provides a gap through which the air can be vented to the atmosphere. In order to achieve a smooth flow of product, the guides are reduced in cross-section by providing a sharp angle on the back side of the guides, like a knife edge with an included angle of 60 degrees. This causes the shape of the stream of product hitting each wall of the carton to be wider and less disrupted. The flow of product is directed at the walls of the carton by aligning the fins with the corners of the carton. The radius at the base of the fins is very small in order to disrupt the flow less and is significant in the reduction of foam.

In operation, a carton 44 is positioned under the discharge valve assembly 8 when the valve element 31 is in engagement with the valve seat 42, so that no liquid flows into the carton. The air cylinder 50 is at the upper extent of its movement, so that the sleeve 18 is in the upper position, corresponding to the position 76 in FIG. 6. Air pressure in the upper end of the cylinder 50 urges the cam follower 72 downwardly into engagement with the cam 70. As the cam 70 rotates, the sleeve 18 is forced downwardly to displace the valve element 31 downwardly and away from the seat 42. A brief interval later, as shown at 78 in FIG. 6, the cam 64 displaces the air cylinder 48 and the sleeve 16 downwardly, thereby reducing the volume of the bellows 12 and 14 in order to cause the liquid to flow into the carton 44.

At the end of the carton fill stroke, as shown at 80 and 82 in FIG. 6, the cam 70 causes the sleeve 18 to move upwardly until the position 84 is reached. A brief interval after the valve element 31 is in engagement with the valve seat 42, the recharge stroke begins (86 in FIG. 6) as cam 64 causes the upper air cylinder 48 to displace the upper sleeve 16 upwardly until the fluid pressure in the middle bellows 12 and in the lower bellows 14 decreases sufficiently to overcome the force of the spring 26. This causes the check valve 22 to open, thereby recharging the product liquid in the interior of the bellows 12 and 14. When upward movement of the air cylinder 48 stops (88 in FIG. 6), liquid pressure in the bellows 10 increases, and the spring 26 forces the valve element 22 to close. The pressure in the bellows 10 remains substantially constant since a substantially constant head of fluid is maintained through the product supply system.

When the operation of the dispensing unit is completed, liquid is drained from the unit by operating the unit without supplying additional liquid through the conduit 4. When the liquid level is below the valve 22, the control 75 is operated to displace the lower cylinder 50 downwardly against the stop 73. This movement causes the sleeve 18 to move downwardly, thereby displacing the valve stem 34 downwardly to lower the valve element 31 away from the valve seat 42. Then, liquid is drained from the bellows 12 and 14, and is discharged through the valve assembly 8.

In order to clean the interior of the dispensing unit, the unit is first drained, and then filled with a cleaning solution. By operating the unit in the manner as described for filling cartons, the cleaning solution runs through the unit. After a sufficient period of time, the remaining cleaning fluid is drained from the unit.

While this invention has been illustrated and described in accordance with a preferred embodiment, it is recognized that variations and changes can be made without departing from the invention as set forth in the following claims.

What is claimed is:

1. Apparatus for dispensing liquids comprising a discharge nozzle having an internal bore, said bore having a central axis;

a movable discharge valve element cooperating with said bore to control liquid flow out of said nozzle;

a valve stem extending from said discharge valve element and along said central axis;

a pair of sleeves arranged coaxially with said valve stem, a first one of said sleeves being spaced from said discharge element a greater distance than the second one of said sleeves, said sleeves being mounted for axial reciprocating motion relative to said discharge nozzle;

a first bellows between said nozzle and said second sleeve, and a second bellows between said first sleeve and said second sleeve;

a third bellows connected with said first sleeve and arranged coaxial with said valve stem, liquid supply means for introducing liquid into said third bellows;

said second sleeve being connected with said valve stem for imparting reciprocating motion to said valve stem upon axial movement of said second sleeve toward said discharge nozzle;

said first sleeve having a control valve element in position to cooperate with said first sleeve to open in response to higher liquid pressure in said third bellows that in said second bellows.

2. The apparatus according to claim 1, including support means for mounting said valve stem with said axis substantially vertical.

3. The apparatus according to claim 1, including drive means for imparting reciprocating motion to said first and second sleeves according to a predetermine time and displacement schedule.

4. The apparatus according to claim 3 wherein said drive means includes first and second air cylinders mounted for reciprocating movement on a common post, said first air cylinder being secured to said first sleeve and said second air cylinder being secured to said second sleeve, and including rotary cam means for selectively displacing said first and second air cylinders according to said predetermined time and displacement schedule.

5. The apparatus according to claim 1, wherein said discharge valve element includes an engagement surface that engages a valve seat on said nozzle when said valve stem is raised relative to said nozzle, said engagement surface of said valve element having a slope of about 45 degrees relative to said central axis, and said valve seat having about the same slope as said engagement surface.

6. The apparatus according to claim 5, wherein said discharge valve element engagement surface and said valve seat having slightly different slopes converging toward the outer periphery of said valve element.

7. The apparatus according to claim 5, wherein said second sleeve includes a central hub for engagement with said valve stem for displacing said discharge valve element away from said valve seat upon displacement of said second sleeve toward said discharge nozzle, and said second sleeve including liquid flow passages communicating between said first and second bellows.

8. The apparatus according to claim 7, including spring means for urging said discharge valve element toward said valve seat.

9. The apparatus according to claim 1, wherein said control valve element has a valve stem and a spring cooperating with the valve stem for urging said element toward a closed position.

10. The apparatus according to claim 9 wherein said valve element includes purge valve means for allowing air to be purged from said second bellows into said third bellows.

11. Apparatus for dispensing liquids comprising:

a machine frame;

a discharge nozzle having an internal bore, a liquid inlet conduit;

support means on said frame for supporting said nozzle and said conduit at fixed locations in alignment along a central axis;

first and second sleeves arranged coaxial with said central axis;

a first bellows mounted between said nozzle and said second sleeve, a second bellows mounted between said second sleeve and said first sleeve, a third bellows mounted between said first sleeve and said liquid inlet conduit;

a discharge valve element mounted in said nozzle for reciprocating movement along said central axis, into and out of engagement with a valve seat, said discharge valve element includes a valve stem, and spring;

said first sleeve having a control valve therein for controlling the flow of liquid from said third bellows to said second bellows when the pressure of the liquid in the third bellows is greater than the pressure in the second bellows;

said second sleeve being in engagement with said valve stem upon movement of said second sleeve toward said nozzle; and said first, second and third bellows being coaxial with said central axis, whereby relative axial motion of said first and second sleeves selectively controls the discharge of liquid out of said nozzle at a predetermined rate.

12. The apparatus according to claim 11, wherein said second sleeve includes a central hub, said discharge valve stem being positioned to engage said hub, said sleeve includes liquid passages for providing liquid communication between said first bellows and said second bellows.

13. The apparatus according to claim 11, wherein said control valve includes a valve seat in said first sleeve in position to cooperate with a movable control valve element, and includes spring means for urging said control valve element toward said valve seat.

14. The apparatus according to claim 13 wherein said control valve includes purge valve means for venting air from said second bellows into said third bellows.

15. The apparatus according to claim 11 wherein said discharge valve element includes guides extending into said nozzle bore.

16. The apparatus according to claim 11 wherein said discharge valve element includes an engagement surface in position to engage said nozzle valve seat, said engagement surface and said valve seat being substantially conical and concentric with said central axis.

17. A method of dispensing liquids into cartons comprising (a) providing a fixed nozzle above a carton that is to be filled, said nozzle having a discharge valve element mounted for reciprocating axial movement between an open and closed position, (b) providing first and second sleeves in substantially axial alignment with said nozzle, with a first bellows between said nozzle and said second sleeve, and a second bellows between said second and said first sleeve, and a third bellows between said first sleeve and a liquid inlet, said first, second and third bellows being mounted in substantially vertical alignment, (c) displacing said second sleeve toward said nozzle while maintaining the volume of said first and second bellows substantially constant, (d) opening said discharge valve element in response to said second sleeve displacing, to allow discharge of liquid from the nozzle, (e) displacing said first sleeve toward said nozzle at a predetermined rate to compensate for the flow of liquid from said nozzle, (f) closing said discharge valve element, and (g) subsequently displacing said first sleeve away from said nozzle to recharge liquid in said first and second bellows, said first sleeve including a check valve to control liquid flow between said second and third bellows.

18. The method according to claim 17, including displacing said second sleeve toward said nozzle to open said control valve element and oscillating said first sleeve along said vertical axis causing liquid to flow through said bellows and said second sleeve and through said nozzle for draining and cleaning.

19. A method of dispensing liquid into cartons comprising:

(a) positioning a carton under a nozzle, said nozzle having a central axis and a discharge valve element between an open and closed position, (b) filling a first and second bellows through a liquid inlet from a third bellows with a predetermined volume of liquid, said bellows being axially aligned with and in liquid communication with said nozzle, said first and second bellows being separated by a second movable sleeve and said second and third bellows being separated by a first movable sleeve, (c) closing the liquid inlet of said first and second bellows, (d) opening the discharge valve element by axial displacement of the valve element, said axial displacement induced by axial displacement of said second sleeve, and (e) maintaining the inlet of said first and second bellows closed while said discharge valve element is opening and (f) subsequently closing said discharge valve element so that a predetermined quantity of liquid is dispensed from said first and second bellows.

20. The method according to claim 19, wherein said discharge valve opening step includes directing the liquid obliquely against the interim wall of the carton to minimize foaming.

21. The method according to claim 19, wherein the fluid pressure of liquid in the first and second bellows is substantially at atmospheric pressure when the discharge valve element opens.

* * * * *